United States Patent [19]

Hacias

[11] 4,289,546

[45] Sep. 15, 1981

[54] AQUEOUS ACIDIC LUBRICANT COMPOSITION AND METHOD FOR COATING METALS

[75] Inventor: Kenneth J. Hacias, Sterling Heights, Mich.

[73] Assignee: Hooker Chemicals & Plastics Corp., Madison Heights, Mich.

[21] Appl. No.: 171,857

[22] Filed: Jul. 24, 1980

Related U.S. Application Data

[63] Continuation-in-part of Ser. No. 64,652, Aug. 7, 1979, abandoned.

[51] Int. Cl.[3] ..... C23F 7/10

[52] U.S. Cl. ..... 148/6.15 R; 148/6.15 Z; 252/49.5; 252/49.8; 252/49.9

[58] Field of Search ..... 148/6.15 R, 6.15 Z; 252/49.5, 48.9, 49.9, 51.5 A

[56] References Cited

U.S. PATENT DOCUMENTS

| | | | |
|---|---|---|---|
| 2,840,498 | 6/1958 | Logue et al. | 148/6.15 Z |
| 2,850,418 | 9/1958 | Otto et al. | 148/6.15 Z |
| 3,525,651 | 8/1970 | Smith | 148/6.15 Z |

FOREIGN PATENT DOCUMENTS

| | | | |
|---|---|---|---|
| 1421386 | 1/1976 | United Kingdom | 148/6.15 Z |

*Primary Examiner*—Ralph S. Kendall

*Attorney, Agent, or Firm*—Arthur E. Kluegel; Richard P. Mueller

[57] ABSTRACT

A composition and a method for applying a lubricant coating to clean metal surfaces prior to subjecting them to metal forming operations. The composition comprises a concentrate which is adapted to be diluted with water, if desired, to produce an aqueous acidic operating bath containing a controlled effective amount of phosphate ions to form a phosphate coating on the clean metal surface in combination with an emulsified organic lubricant agent, an emulsifying agent and an aqueous soluble organic corrosion inhibiting agent. The coating composition may further optionally contain a controlled amount of heavy metal cations for activating the coating bath. The coating composition is applied to a clean metal surface such as by flooding, immersion, spraying, or the like, at temperatures from ambient up to about 200° F. for a period of time sufficient to effect a desired coating magnitude whereafter the parts are dried, preferably at elevated temperatures before forming.

40 Claims, No Drawings

AQUEOUS ACIDIC LUBRICANT COMPOSITION AND METHOD FOR COATING METALS

CROSS REFERENCE TO RELATED APPLICATION

This application is a continuation-in-part of U.S. Ser. No. 64,652 filed Aug. 7, 1979, now abandoned.

BACKGROUND OF THE INVENTION

A variety of compositions and methods have heretofore been used or proposed for use for applying coatings on metal surfaces possessed of lubricating properties to facilitate subsequent metal forming or working operations such as drawing, forging, and the like. Chemical conversion coatings, especially phosphate coatings, have received widespread acceptance for this purpose. Such phosphate conversion coatings are employed in conjunction with supplemental organic lubricating agents such as waxes and soaps to further enhance the lubricity characteristics of the coating formed. It has heretofore been conventional to first subject the metal surfaces to a phosphating treatment to form the requisite phosphate coating thereon whereafter the parts are water rinsed and thereafter are passed into a lubricant tank for applying the supplemental organic lubricant thereto. The problems associated with such a multiple step pretreatment prior to metal forming operations have somewhat been overcome by coating formulations providing a one-step procedure in forming the necessary lubricant coating thereby substantially reducing the treating time, plant space required, investment in capital equipment and labor required.

Typical one-step methods for forming a lubricant coating on metal surfaces are those disclosed in U.S. Pat. Nos. 2,840,498; 2,850,418; and 3,525,651. In accordance with the methods and compositions disclosed in the aforementioned patents, a lubricating agent is emulsified or dispersed in an aqueous solution containing the conversion coating constituent whereby a conversion coating and a deposition of the lubricant additive is simultaneously effected in a so-called one-step operation. At the completion of the coating operation, the surfaces of the metal parts are dried prior to initiation of the metal forming operations.

A continuing problem associated with one-step processes of the types heretofore known has been the formation of rust on the metal surfaces during the drying stage of the process. The presence of water vapor and the high free acid of the emulsion on the metal parts tends to cause rusting particularly in areas and locations which are difficult to reach by the heated recirculating air employed during the drying operation. Such a situation frequently arises when bulk quantities of metal parts are processed in bundles and the points of contact between adjacent work pieces precludes adequate entry of drying air. The presence of such rust not only results in an unacceptable surface on the finished product but also substantially increases resistance during the metal working or drawing process increasing die wear and resulting in improperly worked or fractured metal parts.

A further problem associated with prior art formulations has been the lack of thermal stability of the aqueous solution when heated to elevated temperatures for prolonged time periods. Such lack of thermal stability occurs at least in part from a hydrolysis of some of the bath constituents resulting in a breakdown of the emulsion as evidenced by the presence of an oily layer floating on the surface of the bath.

The present invention overcomes the problems and disadvantages associated with prior art one-step lubricant coating compositions and methods by providing a concentrate useful when diluted with water for forming an operating bath which is of versatile use, effective to produce a satisfactory lubricant coating on a metal surface, which is substantially stable over a broad operating range and which substantially eliminates the formation of rust during the drying stage.

SUMMARY OF THE INVENTION

The benefits and advantages in accordance with one aspect of the present invention, are based on the discovery of an aqueous acidic coating composition suitable for treating metal surfaces, and particularly, iron and steel surfaces prior to metal forming operations containing as essential ingredients, about 0.2% to about 15% by weight phosphate ions, about 0.3 to about 16% of an emulsified organic lubricant selected from the group consisting of $C_8$ to $C_{40}$ carboxylic acid and alcohols including the esters, mono and polyamine salts, mono and polyalkyl ($C_1$–$C_{18}$) amine salts thereof, as well as mixtures thereof; about 0.1% to about 10% of an emulsifying agent selected from the group consisting of N-tallow poly(propyleneamine) having from 1 to 5 propyleneamine groups, oxazoline waxes and mixtures thereof, and about 0.1% to about 5% of a corrosion inhibitor comprising a salt of an organic carboxylic acid of $C_7$–$C_{18}$ and an aliphatic amine up to $C_{12}$ and water. A further aspect of the present invention is based on the discovery that the use of oxazoline compounds as the emulsifying agent alone or in combination with supplemental emulsifying agents with or without the corrosion inhibiting agent imparts a surprising improvement in the thermal stability of the operating bath. The operating bath composition can be conveniently prepared from a concentrate incorporating the aforementioned essential constituents in the upper concentration range, enabling operating bath make-up or replenishment by simply diluting with water to a lower concentration.

The operating bath is controlled at a pH above that at which excessive pickling of the metal surface occurs and below that pH at which an insufficient reaction with the metal surface occurs to produce an acceptable conversion coating. The bath and concentrate may further optionally incorporate ion activating agents of the types conventionally employed in conversion coating compositions including heavy metal cations such as zinc in conventional amounts.

In accordance with the process aspects of the present invention, clean metal surfaces are contacted with the aqueous acidic coating composition such as by immersion, flooding, spraying, and the like, for a period of time sufficient to effect the formation of a desired coating thickness incorporating organic lubricant constituents. Ordinarily, time periods of from about 1 to about 20 minutes are satisfactory. The coating composition can be applied at temperatures ranging from about 80° F. up to about 200° F. with temperatures of about 120° F. to about 160° F. being particularly satisfactory. At the completion of the coating operation, the part is subjected to a drying step to effect substantially complete evaporation of water from the coating. Such drying is preferably conducted at elevated temperatures of about 250° F. to about 350° F. in a hot circulating air oven.

Additional benefits and advantages of the present invention will become apparent upon a reading of the description of the preferred embodiments taken in conjunction with the examples provided.

DESCRIPTION OF THE PREFERRED EMBODIMENTS

The percentages and amounts of the several constituents of the lubricant coating composition as herein disclosed and as set forth in the subjoined claims are expressed in terms of a weight basis unless clearly indicated to the contrary.

The aqueous acidic coating composition in accordance with one aspect of the present invention, contains as essential constituents, phosphate ions in a controlled amount effective to produce a phosphate conversion coating on the metal surface, an organic emulsified lubricant additive possessing lubricity characteristics in an amount to enhance the lubricity of the composite coating formed, a controlled amount of specific emulsifying agents present in an amount to maintain the lubricant additive dispersed in the form of a substantially stable emulsion over the operating conditions of the bath, and a specific organic corrosion inhibiting agent present in an amount effective to inhibit corrosion of the coating parts during the drying stage, and water. In accordance with a second aspect of the present invention, the aqueous acid coating composition, with or without the corrosion inhibiting agent, incorporates as an essential constituent, an oxazoline compound emulsifying agent alone or in combination with supplemental emulsifying agents which provides for an unexpected improvement in the thermal stability of the operating bath. The coating composition may additionally contain as optional constituents, activating ions of any of the types usually employed in phosphate conversion coating baths which are compatible with the essential constituents present and in amounts sufficient to effect an activation of the formation of the conversion coating.

In accordance with one of the composition aspects of the present invention, the aqueous acidic operating bath contains from about 0.2% to about 15% phosphate ions, from about 0.3% to about 16% of an emulsified organic lubricant, about 0.1% to about 10% of the emulsifier, from about 0.1% to about 5% of the organic corrosion inhibitor agent and water. In accordance with the preferred practice, the phosphate ion concentration ranges from about 1.5% to about 6%, the lubricant agent ranges from about 2% to about 6%, the emulsifying agent ranges from about 0.5% to about 4%, and the corrosion inhibitor ranges from about 0.5% to about 1.5%. Of the various activating ions suitable for use, heavy metal cations such as zinc can be employed in amounts sufficient to promote the formation of a phosphate coating up to amounts below that at which undesirable bath instability occurs, with amounts of about 0.1% to about 0.2% being preferred. The operating bath may further include compatible pH adjusters to provide the desired pH of the operating bath. Usually, the phosphate ion concentration is controlled so as to provide the satisfactory pH obviating the need for pH adjusting agents.

The operating bath may range in acidity from a lower pH value at which excessive acid pickling begins to occur to an upper pH value at which insufficient bath reactivity begins to occur, preventing formation of a satisfactory coating. Usually, a pH ranging from about 2.4 to about 3.4 is satisfactory while a pH ranging of from about 2.8 to about 3.1 is preferred.

The phosphate ion constituent of the bath can be suitably introduced in the form of a concentrated phosphoric acid. Zinc may be suitably introduced as zinc oxide in a concentration of from about 0.1% to about 1% zinc. Preferably, the phosphoric acid and zinc oxide may be precombined to form a zinc acid phosphate which may then be used to supply both zinc and phosphate constituents. The presence of the heavy metal zinc cation is preferred particularly in the preparation of a fresh bath to activate the composition. During use of the coating bath, dissolution of iron from the metal surface occurs further providing iron cations in the coating bath. A portion of the metal cation activators are removed as a result of dragout and are replenished by dissolution of iron. from the metal surface as well as by periodic replenishment of the coating bath with a concentrate containing such activators if desired.

In addition to the heavy metal cations, the bath and concentrate may further contain conventional accelerators and activators as well as pH adjusters of the types and in the concentrations conventionally employed which are compatible with and do not adversely affect the stability of the emulsion. Generally, the inclusion of such supplemental additives is not necesary to achieve satisfactory coating results.

The lubricant constituent of the bath comprises an organic emulsifiable carboxylic acid and/or alcohol containing from 8 to 40 carbon atoms as well as esters, mono and polyamine and/or mono and polyalkyl ($C_1$–$C_{18}$) amine salts as well as mixtures thereof. The lubricant constituent may be of saturated or unsaturated form and of a natural or synthetic origin.

The lubricating agent may be comprised of up to 50% of the total lubricant present of N-tallow-1,3 propanediamine dioleate which possesses good film forming properties and acts as a boundary lubricant. This lubricant additive also possesses emulsifying properties and has cationic activity further contributing to the provision of a substantially stable emulsion.

In addition to the aforementioned phosphate ions and lubricant additives, the bath further contains as an emulsifier, N-tallow poly(propyleneamine) having from 1 to 5 propyleneamine groups of a composition corresponding to the following structural formula:

$$R—[NH—CH_2—CH_2—CH_2]_n—NH_2$$

wherein:

R is tallow and n is 1 to 5 or mixtures thereof and/or a series of oxazoline compounds which are synthetic wax derivatives of oxazoline, a five-membered heterocyclic ring compound, corresponding to the following structural formula:

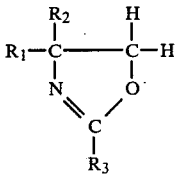

wherein: $R_1$, $R_2$ and $R_3$ are the same or different and are selected from the group consisting of esters, alcohols, carboxylic acids and hydrocarbons containing 1 to 36 carbon atoms, and $R_2$ may also be H.

Examples of such oxazoline compounds in accordance with the foregoing structural formula which are effective and commercially available under the brand designation Wax TS 254, Wax TS 254 A, Wax TS 254 AA, Wax TS 970, Alkaterge E and Alkaterge T which are available from NP Division of IMC Chemical Group, Inc. of Hillsdale, Ill.

The oxazoline emulsifying agent in accordance with a further aspect of the present invention, imparts surprising thermal stability to the emulsified operating bath, with or without the corrosion inhibitor agent, particularly when heated for extended time periods above about 160° F. At such elevated temperatures under the acidic conditions present, the organic lubricant additives in the bath tend to hydrolyze and demulsify as evidenced by a floating oily layer on the surface of the bath. The use of the oxazoline emulsifying agent by itself or in combination with supplemental emulsifying agents, imparts an unexpected increase in thermal stability to the emulsion at such high temperatures.

The foregoing emulsifier agents also possess some lubricity characteristics and further contribute to the lubricating properties of the deposited coating.

In addition to the foregoing constituents, the bath in accordance with one aspect of the present invention, further contains an organic corrosion inhibitor comprising a salt of a $C_7$–$C_{18}$ carboxylic acid and an aliphatic amine containing up to $C_{12}$, preferably, a salt of an alkanolamine of which the salt of octanoic acid and triethanolamine and the salt of stearic acid and triethanolamine constitute the preferred materials. A corrosion inhibitor of the foregoing type reported to contain 40% triethanolamine octanoate suitable for use in accordance with the present invention is available under the brand designation Synkad 303, which is available from Keil Chemical Division of Ferro Corporation, Indiana, U.S.A., in the form of a solution having a viscosity of 230 SUS, at 100° F.; a specific gravity of 1.07 g/ml at 77° F. This commercial corrosion inhibiting agent contains about 30% volatiles and a preferred form designated at Synkad 303 HT of increased concentration is preferably employed.

The corrosion inhibiting effect of the carboxylic acid-amine salt on the processed ferrous work pieces is surprising in view of the fact that alternative oil soluble corrosion inhibitors have been unsatisfactory in such one-step coating baths because they are ineffective to prevent rusting until such time that substantially all of the water phase in the emulsion has been evaporated and by which time undesirable surface rusting has already taken place. Corrosion inhibitors such as amides and imidazolines have also been found ineffective at the low operating pH of the bath or have been found to cause emulsion instability or to inhibit the formation of a satisfactory conversion coating on the metal surface. The corrosion inhibitor of the operating bath of the present invention not only achieves satisfactory rust inhibition, but also provides for a substantially stable emulsion.

The foregoing constituents in combination with the optional ingredients as hereinabove described are employed in the operating bath in the concentrations as previously set forth. Phosphate ion concentrations of less than about 0.2% are generally unsatisfactory because of the excessive time required to form a phosphate coating of the requisite weight while concentrations in excess of about 15% are undesirable because of the tendency of such higher concentrations to cause instability of the emulsion under some circumstances. The lubricant additive can be employed in amounts of 0.3% to about 16% since amounts less than about 0.3% are undesirable because of insufficient lubricity of the coating for some metal forming operations while amounts in excess of about 16% are unsatisfactory because of the excessive viscosity of the operating bath. The emulsifying agent should be employed in the amount necessary to emulsify the lubricant constituent present and will vary in the disclosed range in consideration of the concentration of lubricant present. The corrosion inhibitor is employed in the operating bath from about 0.1% up to about 5%. Amounts of the corrosion inhibitor in excess of about 5% are undesirable because no significant improvement in corrosion inhibition is obtained over that obtained at concentrations of 5% or less and such excessive concentrations contribute toward instability of the emulsion whereas amounts less than about 0.1% are undesirable because of insufficient corrosion inhibition in some situations.

The foregoing operating bath is conventionally prepared employing a concentrate of the essential constituents within the permissible upper concentration limits which is suitable after dilution with water to form an operating bath of the desired lower concentration. While such a concentrate can itself be employed as the operating bath in some situations, the relatively high viscosity of such concentrates makes it desirable to dilute them with water to produce an operating bath within the preferred concentration ranges as hereinbefore set forth.

A concentrate suitable for further dilution with water can be conveniently prepared by mixing the lubricating agent and emulsifying agent and heating the mixture to form a molten mass. A hot aqueous solution is prepared containing the phosphate ions and supplemental optional aqueous soluble constituents to which the molten organic mixture is slowly added in the presence of vigorous agitation effecting a dispersion of the organic phase into globules forming an emulsion. The aqueous phosphate solution is preferably heated within a range of about 160° up to about 200° F. and maintained within that range during the addition of the organic mixture. The resultant emulsified concentrate is thereafter cooled.

It is also contemplated that the emulsifying agent can be added directly to the heated aqueous phosphate solution whereafter the molten lubricant additive is added in the presence of agitation.

The resultant concentrate can be directly employed or can be further diluted with water to prepare an operating bath by the addition of appropriate quantities of water to provide the desired final concentration. The resultant bath is preferably heated to an elevated temperature during use to increase the activity and formation of the phosphate conversion coating. The emulsified particles of lubricant in the concentrate may solidify depending on their specific melting point during the cooling of the concentrate. Such solid particles nevertheless remain dispersed in the aqueous phase. Upon subsequent heating of the coating bath, certain of the particles depending upon their melting point may again become molten. The specific form of the particles as liquid globules or solid particles is immaterial to the formation of a satisfactory lubricant coating on the metal surfaces.

The operating bath can be employed at temperatures ranging from ambient temperature up to about 200° F. with temperatures of from about 120° F. to about 160° F. being particularly satisfactory. The coating bath composition can be applied to the metal surface by flooding, immersion, spraying, and the like, of which immersion is preferred, so as to provide intimate contact therebetween. To maintain bath uniformity, the bath is preferably agitated. The duration of the contact time will vary depending upon the composition of the coating composition, the concentration thereof, the temperature of application, and the desired coating weight required in consideration of the severity of the metal forming operations to which the articles are to be subjected. Ordinarily, contact times employing an immersion technique of from about one minute up to about twenty minutes is satisfactory. The coating formed comprises a phosphate coating having lubricant particles occluded therein or deposited thereon.

The coated articles at the conclusion of the contact time is subjected to a drying stage prior to metal forming. The drying step can be accomplished at temperatures ranging from ambient temperature up to about 350° F. with temperatures of from about 250° F. to about 350° F. being preferred due to the accelerated drying rate obtained. During the drying step at elevated temperature, the lubricant particles may coalesce into a film. Such coalescense, however, is not important in achieving satisfactory lubricant coatings in that solid particles dispersed in or on the phosphate coating also provide for satisfactory lubricity during subsequent metal working operations.

The metal articles prior to the coating operation are subjected, if necessary, to conventional precleaning treatments to remove contaminating substances and scale from the surfaces thereof providing for a clean surface.

In order to further illustrate the present invention, the following specific examples are provided. It will be understood that the examples are provided for illustrative purposes and are not intended to be limiting of the scope of the present invention as herein described and as set forth in the subjoined claims.

EXAMPLE I

A concentrate is prepared in accordance with prior art practice, devoid of any corrosion inhibitor, containing 2.6% zinc acid phosphate (14% zinc, 48% $PO_4$), 5.6% phosphoric acid (75%), 2.0% N-tallow polypropylene tetramine emulsifying agent commercially available under the brand name Jet Amine TET from Jetco Chemicals, Inc. of Texas; and as a lubricating agent, a mixture of high molecular weight constituents present in an amount based on the total concentrate of 2.9% stearic acid (95% $C_{18}$), 2.5% of partially oxidized high molecular weight acids, esters and alcohols commercially available under the brand name ALOX 600 from Alox Corporation and 2.0% N-tallow 1,3 propanediamine dioleate, commercially available under the brand name Duomeen TDO from Armak Chemicals Div. of Akzona Incorporated of Chicago, Ill., and the remainder water. The concentrate is employed to make up an operating bath by dilution with water at a ratio of 1 volume concentrate for three volumes water. The resultant operating bath is heated to a temperature of 170° F.

Cold rolled steel unpolished panels of a size 3"×4" are cleaned by immersion for a period of five minutes in an aqueous cleaning solution at a temperature of 180° F. whereafter the panels are water rinsed for one minute. The panels are thereafter immersed in the operating bath for a period of ten minutes. Upon extraction from the bath, a pair of the wet coated panels are placed in face to face overlying relationship in a horizontal position and are placed in an oven at 175° F. for a period of one hour. After the one hour drying phase, the facing surfaces of the test panels are examined for rust. An inspection of the test specimens reveals an area of about 10 to 20% of red rust on the two facing surfaces.

EXAMPLE II

The operating bath as described in Example I is modified in accordance with the practice of the present invention by the addition of ½ gram per liter of a corrosion inhibiting agent consisting of triethanolamine octanoate produced by the neutralization reaction between ¼ gram triethanolamine and ¼ gram octanoic acid and a second set of panels is processed in the same manner as previously described. An examination of the facing surfaces of the panels after a period of one hour drying in the oven reveals substantially no rust on the facing surfaces. A series of supplemental panels processed under the same processing cycle as hereinabove described employing the bath composition of the present invention reveals substantially no rusting on the facing surfaces with the areas of the opposed faces exhibiting zero up to 2% rust.

EXAMPLE III

An operating bath is prepared employing the concentrate as described in Example I, devoid of any corrosion inhibiting agent. The operating bath is prepared by adding 60 gallons of the concentrate to 340 gallons of water and thereafter heating the bath to 160° F.

A bundle of about 250 type 5048 alloy tubes having a diameter of 0.5", a wall thickness of 0.019" and a length of 12' are precleaned by subjecting them to a ten minute immersion in a 10% sulfuric acid pickling solution, followed by a one minute cold water rinse and a second one minute cold water rinse. The cleaned tubes in a bundle are thereafter subjected to two dips in the operating bath, each for a duration of two minutes whereafter they are drawn and placed in a tube dryer at a temperature of 325° F. for a period of two hours. An inspection of the tubes at the completion of the drying cycle reveals the formation of rust along the contacting surfaces of the adjacent tubes.

EXAMPLE IV

The operating bath as described in Example III is modified in accordance with the present invention by adding about seven gallons of the triethanolamine octanoate corrosion inhibiting agent in the form of ten gallons of Synkad 303 (70%) whereafter subsequent bundles of tubes were processed employing the cycle as hereinabove described. An inspection of the tubes after the drying cycle employing the operating bath of the present invention shows no signs of rust. The foregoing operating bath is employed for processing several thousand tubes over a period of three weeks with no signs of rust on the tubes treated or instability of the operating bath.

EXAMPLE V

A concentrate is prepared containing 43.9 g of an aqueous solution containing 10% by weight zinc and 34.4% by weight phosphate ions, 65.5 g of 75% phosphoric acid, 825.6 g water, 25 g of Alox 600 (as defined in Example I), 29 g of stearic acid (95% $C_{18}$), and 40 g of N-tallow polypropylene tetramine emulsifying agent (Jet Amine TET). The concentrate is diluted with 75% by volume water and 28 g of a corrosion inhibiting agent consisting of triethanolamine octanoate are added.

The operating bath provides satisfactory lubricant coatings without any significant rusting on the coated parts. The operating bath is subjected to an accelerated thermal stability test by heating to 160° F. without agitation for a period of eight days and remains stable incurring only minimal hydrolysis of the organic constituents.

EXAMPLE VI

A series of operating baths is prepared of a composition corresponding to that of Example II with the exception that the 2% N-tallow 1,3 propanediamine dioleate is omitted and a corresponding amount of an oxazoline compound is substituted in the concentrate for the purpose of providing improved thermal stability to the operating bath. The series of baths comprises bath A containing Wax TS-254, bath B containing Wax TS-254AA, bath C containing Wax TS-970, bath D containing Alkaterge E, and bath E containing Alkaterge T. The baths A-E and a sample of the bath of Example II are subjected to accelerated thermal stability tests by heating them without agitation to a temperature of 160° F. and maintaining them at that temperature. The bath of Example II comprising the control is observed at the end of two days to have a thick oily layer floating on the top surface evidencing hydrolysis of the organic constituents therein and a loss of stability. In comparison, baths A-E remained stable under these same conditions for at least 4 days.

EXAMPLE VII

A series of operating baths is prepared similar to Example VI with the exception that the corrosion inhibiting agent triethanolamine octanoate is omitted from the concentrate. Similar improvements in the thermal stability of the test baths are obtained.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous acidic lubricant coating composition for treating metal surfaces prior to metal forming operations comprising an aqueous emulsion containing:

(a) from about 0.2% to about 15% by weight phosphate ions;

(b) from about 0.3% to about 16% of an emulsified organic lubricant selected from the group consisting of $C_8$ to $C_{40}$ carboxylic acids and alcohols including the esters, mono and polyamide salts, mono and polyalkyl ($C_1$–$C_{18}$) amine salts thereof as well as mixtures thereof;

(c) from about 0.1% to about 10% of an emulsifying agent selected from the group consisting of N-tallow poly(propyleneamine) having from 1 to 5 propyleneamine groups, oxazoline waxes and mixtures thereof;

(d) from about 0.1% to about 5% of a corrosion inhibitor comprising a salt of a $C_7$–$C_{18}$ carboxylic acid and an aliphatic amine containing up to $C_{12}$; and (e) water.

said composition having a pH above that at which excessive pickling of the metal surface occurs and below that at which insufficient reaction with the metal surface occurs to form a phosphate coating.

2. The composition as defined in claim 1 in which said lubricant comprises up to 50% of N-tallow 1,3 propanediamine dioleate.

3. The composition as defined in claim 1 further including heavy metal ions.

4. The composition as defined in claim 1 in which said $C_8$ to $C_{40}$ lubricant constituent is comprised of a major portion of $C_8$ to $C_{24}$ constituents.

5. The composition as defined in claim 1 containing:

(a) from about 1.5% to about 6% of said phosphate ions;

(b) from about 2% to about 6% of said lubricant;

(c) from about 0.5% to about 4% of said emulsifying agent; and (d) from about 0.5% to about 1.5% of said corrosion inhibitor.

6. The composition as defined in claim 1 having a pH of about 2.4 to about 3.4.

7. The composition as defined in claim 1 having a pH of about 2.8 to about 3.1.

8. The composition as defined in calim 3 in which said heavy metal cations are selected from the group consisting of iron, zinc and mixtures thereof.

9. The composition as defined in claim 1 in which said corrosion inhibitor comprises a salt of said carboxylic acid and an alkanolamine.

10. The composition as defined in claim 1 in which said corrosion inhibitor comprises a salt of said carboxylic acid and triethanolamine.

11. The composition as defined in claim 1 in which said corrosion inhibitor comprises a salt of octanoic acid and triethanolamine.

12. The composition as defined in claim 1 in which said corrosion inhibitor comprises a salt of stearic acid and triethanolamine.

13. A method of treating a clean metal surface to form a lubricant coating thereon prior to metal forming operations which comprises the steps of contacting said surface with a composition as defined in claim 1 for a period of time sufficient to form a coating and thereafter drying said surface.

14. The method as defined in claim 13 in which said composition is at a temperature ranging from ambient temperature up to about 200° F.

15. The method as defined in claim 13 in which said composition is at a temperature of about 120° F. to about 160° F.

16. The method as defined in claim 13 in which the step of drying said surface is performed at a temperature ranging from ambient up to about 350° F.

17. The method as defined in claim 13 in which the step of drying is performed at a temperature ranging from about 250° F. to about 350° F.

18. The method as defined in claim 13 in which the step of contacting said surface with said composition is performed for a period ranging from about one to about 20 minutes.

19. The method as defined in claim 13 in which said composition is at a pH of about 2.4 to about 3.4.

20. An aqueous acidic lubricant coating composition for treating metal surfaces prior to metal forming operations possessing improved thermal stability comprising an aqueous emulsion containing:

(a) from about 0.2% to about 15% by weight phosphate ions;

(b) from about 0.3% to about 16% of an emulsified organic lubricant selected from the group consisting of $C_8$ to $C_{40}$ carboxylic acids and alcohols including the esters, mono and polyamide salts, mono and polyalkyl ($C_1$–$C_{18}$) amine salts thereof as well as mixtures thereof;

(c) from about 0.1% to about 10% of an emulsifying agent comprising an oxazoline compound; and (d) water.

said composition having a pH above that at which excessive pickling of the metal surface occurs and below that at which insufficient reaction with the metal surface occurs to form a phosphate coating.

21. The composition as defined in claim 20 in which said lubricant comprises up to 50% of N-tallow 1,3 propanediamine dioleate.

22. The composition as defined in claim 20 further including heavy metal ions.

23. The composition as defined in claim 20 in which said $C_8$ to $C_{40}$ lubricant constituent is comprised of a major portion of $C_8$ to $C_{24}$ constituents.

24. The composition as defined in claim 20 containing:

(a) from about 1.5% to about 6% of said phosphate ions;

(b) from about 2% to about 6% of said lubricant; and (c) from about 0.5% to about 4% of said emulsifying agent.

25. The composition as defined in claim 20 having a pH of about 2.4 to about 3.4.

26. The composition as defined in claim 10 having a pH of about 2.8 to about 3.1.

27. The composition as defined in claim 22 in which said heavy metal cations are selected from the group consisting of iron, zinc and mixtures thereof.

28. The composition as defined in claim 20 further including a corrosion inhibitor comprising a salt of a $C_7$ to $C_{18}$ carboxylic acid and an aliphatic amine containing up to $C_{12}$.

29. The composition as defined in claim 28 in which said corrosion inhibitor comprises a salt of said carboxylic acid and triethanolamine.

30. The composition as defined in claim 28 in which said corrosion inhibitor comprises a salt of octanoic acid and triethanolamine.

31. The composition as defined in claim 28 in which said corrosion inhibitor comprises a salt of stearic acid and triethanolamine.

32. The composition as defined in claim 20 in which said oxazoline compound corresponds to the following structural formula:

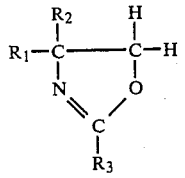

wherein: $R_1$, $R_2$ and $R_3$ are the same or different and are selected from the group consisting of esters, alcohols, carboxylic acids and hydrocarbons containing 1 to 36 carbon atoms, and $R_2$ may also be H.

33. The composition as defined in claim 20 further including a supplemental emulsifying agent comprising N-tallow polypropylene tetramine.

34. A method of treating a clean metal surface to form a lubricant coating thereon prior to metal forming operations which comprises the steps of contacting said surface with a composition as defined in claim 20 for a period of time sufficient to form a coating and thereafter drying said surface.

35. The method as defined in claim 34 in which said composition is at a temperature ranging from ambient temperature up to about 200° F.

36. The method as defined in claim 34 in which said composition is at a temperature of about 120° F. to about 160° F.

37. The method as defined in claim 34 in which the step of drying said surface is performed at a temperature ranging from ambient up to about 350° F.

38. The method as defined in claim 34 in which the step of drying is performed at a temperature ranging from about 250° F. to about 350° F.

39. The method as defined in claim 34 in which the step of contacting said surface with said composition is performed for a period ranging from about one to about 20 minutes.

40. The method as defined in claim 34 in which said composition is at a pH of about 2.4 to about 3.4.

* * * * *